US006381940B1

(12) United States Patent
Kolmes et al.

(10) Patent No.: US 6,381,940 B1
(45) Date of Patent: May 7, 2002

(54) MULTI-COMPONENT YARN AND METHOD OF MAKING THE SAME

(75) Inventors: Nathaniel H. Kolmes; Della B. Moore, both of Hickory; George M. Morman, Jr., Moravian Falls; Richie D. Phillips; Eric Pritchard, both of Hickory, all of NC (US)

(73) Assignee: Supreme Elastic Corporation, Conover, NC (US)

( * ) Notice: Subject to any disclaimer, the term of this patent is extended or adjusted under 35 U.S.C. 154(b) by 0 days.

(21) Appl. No.: 09/552,099

(22) Filed: Apr. 19, 2000

(51) Int. Cl.[7] ..... D02G 1/16

(52) U.S. Cl. ..... 57/245; 57/210; 57/211; 57/212; 57/213; 57/214; 57/216; 57/218; 57/220; 57/221; 57/222; 57/243; 57/244

(58) Field of Search ..... 57/210, 211, 212, 57/213, 214, 216, 218, 220, 243, 221, 244, 222, 245

(56) References Cited

U.S. PATENT DOCUMENTS

| | | | | |
|---|---|---|---|---|
| 3,972,174 A | | 8/1976 | London, Jr. et al. | 57/140 J |
| 4,086,751 A | | 5/1978 | Hino et al. | 57/157 TS |
| 4,464,894 A | | 8/1984 | Leininger | 57/288 |
| 4,470,251 A | | 9/1984 | Bettcher | 57/230 |
| 4,499,717 A | | 2/1985 | Dimitrov | 57/297 |
| 4,545,835 A | | 10/1985 | Gusack et al. | 156/180 |
| 4,750,324 A | | 6/1988 | Tochacek et al. | 57/210 |
| 4,777,789 A | | 10/1988 | Kolmes et al. | 57/210 |
| 4,838,017 A | | 6/1989 | Kolmes et al. | 57/210 |
| 4,934,134 A | | 6/1990 | Niederer | 57/350 |
| 5,023,953 A | | 6/1991 | Bettcher | 2/126 |
| 5,070,540 A | | 12/1991 | Bettcher et al. | 2/2.5 |
| 5,119,512 A | | 6/1992 | Dunbar et al. | 2/167 |
| 5,146,628 A | | 9/1992 | Herrmann et al. | 2/161 R |
| 5,146,660 A | | 9/1992 | Ritter | 28/274 |
| 5,177,948 A | | 1/1993 | Kolmes et al. | 57/229 |
| H1225 H | * | 9/1993 | Foy et al. | 57/5 |
| 5,275,618 A | | 1/1994 | Koyfman et al. | 606/228 |
| 5,518,814 A | | 5/1996 | Bonigk | 428/365 |
| 5,549,966 A | | 8/1996 | Sassa | 428/229 |
| 5,579,628 A | | 12/1996 | Dunbar et al. | 57/246 |
| 5,597,641 A | | 1/1997 | Suematsu et al. | 428/195 |
| 5,597,649 A | | 1/1997 | Sandor et al. | 428/370 |
| 5,628,172 A | | 5/1997 | Kolmes et al. | 57/210 |
| 5,644,909 A | | 7/1997 | Knoff et al. | 57/293 |
| 5,713,113 A | | 2/1998 | Demir | 28/274 |
| 5,746,046 A | | 5/1998 | McCartney et al. | 57/350 |
| 5,845,476 A | | 12/1998 | Kolmes | 57/220 |

* cited by examiner

*Primary Examiner*—John J. Calvert
*Assistant Examiner*—Shaun R Hurley
(74) *Attorney, Agent, or Firm*—Womble Carlyle Sandridge & Rice, PLLC; C. Robert Rhodes

(57) ABSTRACT

A cut-resistant combined yarn is described that includes a wire component. Kinking and knotting of the wire component resulting from stretching of the wire component during knitting is avoided by encasing the wire component within a cut resistant combined yarn that has a higher stretch resistance than the wire component. The combined yarn includes at least one strand of stainless steel, at first non-metallic strand of an inherently cut-resistant material, and a second non-metallic strand of a cut resistant material, a non-cut resistant material or fiberglass. The non-metallic strands are air interlaced with each other to form intermittent attachment areas along the lengths of the strands. At least one or the other of the strands is a multi-filament strand. During air interlacing operation, the two non-metallic strands encase the stainless steel strand in the non-metallic strands at least in some of the zones. A composite yarn may be formed by wrapping at least one cover strand wrapped about the combined yarn in a first direction. A second cover strand may be wrapped about the combined yarn in a second direction opposite the first direction.

20 Claims, 2 Drawing Sheets

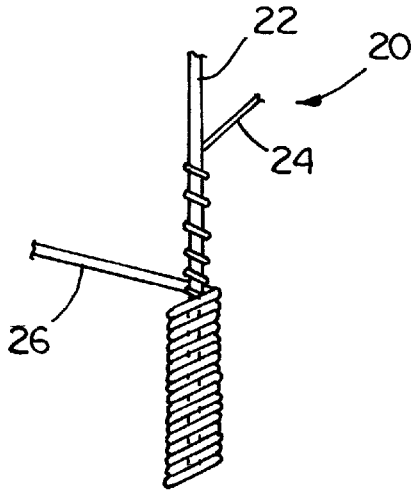
FIG. 2
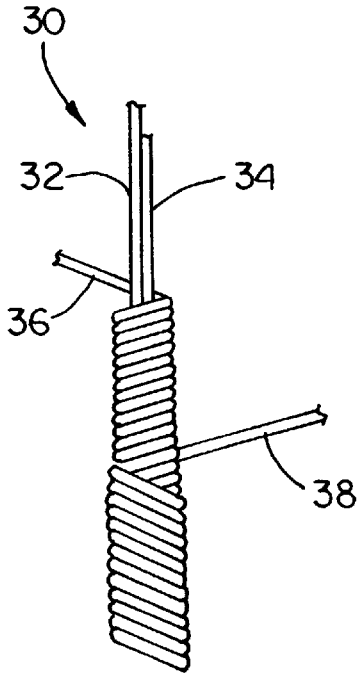
FIG. 3
FIG. 5
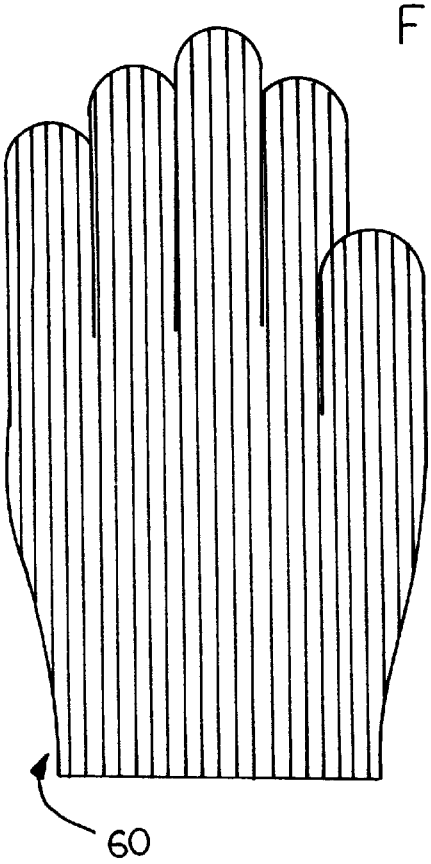
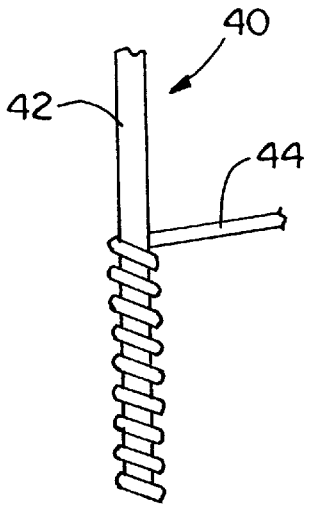
FIG. 4

MULTI-COMPONENT YARN AND METHOD OF MAKING THE SAME

FIELD OF THE INVENTION

The present invention relates to the field of cut and abrasion resistant combined yarns including a metallic component, to composite yarns including such combined yarns, and to the application of air interlacing technology to the manufacture of such combined yarns.

BACKGROUND OF THE INVENTION

The present invention relates to composite yarns useful in the manufacture of various types of protective garments such as cut and puncture resistant gloves, aprons, and glove liners, and in particular to composite yarns useful for the manufacture of these garments that include a metallic strand as a part of the yarn construction.

Composite yarns that include a metallic yarn component, and cut-resistant garments prepared therefrom are known in the prior art. Representative patents disclosing such yarns include U.S. Pat. Nos. 4,384,449 and 4,470,251. U.S. Pat. No. 4,777,789 describes composite yarns and gloves prepared from the yarns, in which a strand of wire is used to wrap the core yarn. The core components of these prior art composite yarns may be comprised of cut-resistant yarns, non-cut resistant yarns, fiberglass and/or a metallic strand, such as stainless steel. One or more of these components may also be used in one or more cover yarns that are wrapped around the core yarn.

It is well known in the art to manufacture such composite yarns by combining an inherently cut-resistant yarn with other strands using wrapping techniques. For example, these yarns may use a core construction comprising one or more strands that are laid in parallel relationship or, alternatively, may include a first core strand that is overwrapped with one or more additional core strands. These composite yarns can be knit on standard glove-making machines with the choice of machine being dependent, in part, on the yarn size.

Wrapping techniques are expensive because they are relatively slow and often require that separate wrapping steps be made on separate machines with intermediate. wind up steps. Further, those techniques require an increased amount of yarn per unit length of finished product depending on the number of turns per inch used in the wrap. Generally, the greater the number of turns per inch, the greater the expense associated with making the composite yarn. When the yarn being wrapped is high performance fiber, this cost may be high.

Knitted gloves constructed using a relatively high percentage of high performance fibers do not exhibit a soft hand and tend to be stiff. This characteristic is believed to result from the inherent stiffness of the high performance fibers. It follows that the tactile response and feedback for the wearer is reduced. Because these gloves typically are used in meat-cutting operations around sharp blades, it would be desirable to maximize these qualities in a cut-resistant glove.

The use of a stainless steel or other wire strand, as at least a part of the core yarn, provides enhanced cut resistance in garments, such as gloves. However, various disadvantages of prior art composite yarns incorporating a stainless steel or other wire strand have been noted. For example, there has been, with prior art yarn construction techniques, a risk of breakage of some of the wire strands, resulting in exposed wire ends that can penetrate the user's skin.

Also, during knitting, the wire component of the yarn tends to kink and form knots when subjected to the forces normally incurred during knitting. Wire strands alone cannot be knitted for this reason. While the problem is somewhat lessened by combining the wire strand or strands with other fibers as taught in the prior art, the wire component still tends to kink, knot or break, thereby lessening its usefulness in cut-resistant garments.

Thus, there is still a need for a composite yarn that includes a wire component that does not significantly kink and form knots during knitting. There is also a need for a less expensive and time consuming technique for combining cut-resistant and non-cut-resistant yarn strands with wire strands to create a single combined strand, and for the resultant yarns and garments manufactured therefrom.

SUMMARY OF THE INVENTION

In accordance with the present invention, it has been found that stretch-resistant composite yarns that include a wire component can be produced by incorporating or "encasing" one or more metallic strands into a strand produced by intermittently air interlacing two or more non-metallic fiber strands, at least one of the strands being of a cut resistant material that is "stronger" than the wire strand having a higher tenacity and a greater resistance to stretching. Combining this stronger cut-resistant strand with the wire strand prevents kinking and forming of knots in the wire strand during knitting, thereby providing a yarn with the desired advantages of wire strands, without the disadvantages previously experienced.

The other strand used in construction of the yarn may be a cut resistant material, a non-cut resistant material and/or fiberglass. At least one of the fiber strands is a multifilament strand. The resulting combined yarn is useful alone or with other yarns in manufacturing garments, such as gloves that have surprising softness, hand and tactile response, without kinks or knots due to stretching of the wire component during garment manufacture.

The invention further relates to a method of making cut resistant combined yarns including the steps of feeding a plurality of yarn strands into a yarn air texturizing device strands to form attachment points intermittently along the lengths of the non-metallic strands, wherein the plurality of strands includes (i) at least one wire strand;

(ii) a first non-metallic fiber strand comprised of an inherently cut resistant material; and (iii) at least one additional non-metallic strand comprised of an inherently cut resistant material, a non-cut resistant material or fiberglass, at least one of the non-metallic fiber strands being a multifilament strand.

The first and additional non-metallic fiber strands may be identical, i.e., both or all strands may be multifilament strands of a cut resistant material. Alternatively, the cut resistant strand can be combined with a non-cut resistant strand, with one of the stands being a multifilament strand, and the other strand being a spun yarn.

The wire strand will normally be a monofilament, e.g., a single wire. During air interlacing, the non-metallic yarn fibers are whipped about by the air jet entangling the fibers of the two non-metallic yarns, and forming attachment areas, points or nodes along the length of the wire. During air interlacing, the individual fibers of the two non-metallic strands are interlaced with each other around the stainless steel strand, which is normally a single filament, encasing or incorporating the stainless steel strand within the interlaced non-metallic strands, at least in some of the zones. At other times the wire may be alongside the non-metallic strands, however since at times the non-metallic strands are interlaced around the wire, the term "around" is appropriate and will be used hereinafter. As a result of the support provided by the entangled yarns at the intermittent attachment points, the bending capability of the wire component is significantly increased, minimizing breakage problems previously encountered.

These combined yarns can be used alone in the manufacture of items such as cut resistant garments, or can be combined in parallel with another yarn during product manufacture. Alternatively, the combined yarns may be used as a core yarn in composite yarns, with a first cover strand wrapped about the combined strands in a first direction. A second cover strand may be provided wrapped about the first cover strand in a second direction opposite that of the first cover strand.

Processes involving treatment of yarns with air jets are well-known in the prior art. Some of these treatments are used to create textured yarns. The term "texturing" refers generally to a process of crimping, imparting random loops, or otherwise modifying continuous filament yarn to increase its cover, resilience, warmth, insulation, and/or moisture absorption. Further, texturing may provide a different surface texture to achieve decorative effects. Generally, this method involves leading yarn through a turbulent region of an air-jet at a rate faster than it is drawn off on the exit side of the jet, e.g., overfeeding. In one approach, the yarn structure is opened by the airjet, loops are formed therein, and the structure is closed again on exiting the jet. Some loops may be locked inside the yarn and others may be locked on the surface of the yarn depending on a variety of process conditions and the structure of the air-jet texturizing equipment used. A typical airjet texturizing devices and processes is disclosed in U.S. Pat. No. 3,972,174.

Another type of air jet treatment has been used to compact multifilament yarns to improve their processibility. Flat multifilament yarns are subjected to a number of stresses during weaving operations. These stresses can destroy interfilament cohesion and can cause filament breakages. These breakages can lead to costly broken ends. Increasing interfilament cohesion has been addressed in the past by the use of adhesives such as sizes. However, air compaction has enabled textiles processors to avoid the cost and additional processing difficulties associated with the use of sizes. The use of air compaction for high strength and non-high strength yarns is disclosed in U.S. Pat. Nos. 5,579,628 and 5,518,814. The end product of these processes typically exhibits some amount of twist.

Other prior art, such as U.S. Pat. Nos. 3,824,776; 5,434,003 and 5,763,076, and earlier patents referenced therein, describe subjecting one or more moving multifilament yarns with minimal overfeed to a transverse air jet to form spaced, entangled sections or nodes that are separated by sections of substantially unentangled filaments. This intermittent entanglement imparts coherence to the yarn, avoiding the need for twisting of the yarns. Yarns possessing these characteristics are sometimes referred to in the prior art as "interlaced" yarns, and at other times as "entangled" yarns.

While intermittent air entanglement of multifilament yarns has been used to impart yarn coherence, the application of this technology to combining yarns including a cut resistant yarn component and a wire component has not been recognized, nor has the resultant advantages and properties of combined yarns resulting from the application of this technology.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which:

FIG. 2 is an illustration of a preferred embodiment of a composite yarn in accordance with the principles of the present invention having a single core strand of a combined yarn and two cover strands;

FIG. 3 is an illustration of an alternative embodiment of a composite yarn in accordance with the principles of the present invention having two core strands and two cover strands;

FIG. 4 is an illustration of an alternative embodiment of a composite yarn in accordance with the principles of the present invention having a single core strand and a single cover strand;

FIG. 5 is an illustration of a protective garment, namely a glove, in accordance with the principles of the present invention.

DETAILED DESCRIPTION OF THE PREFERRED EMBODIMENT

Figure 1:
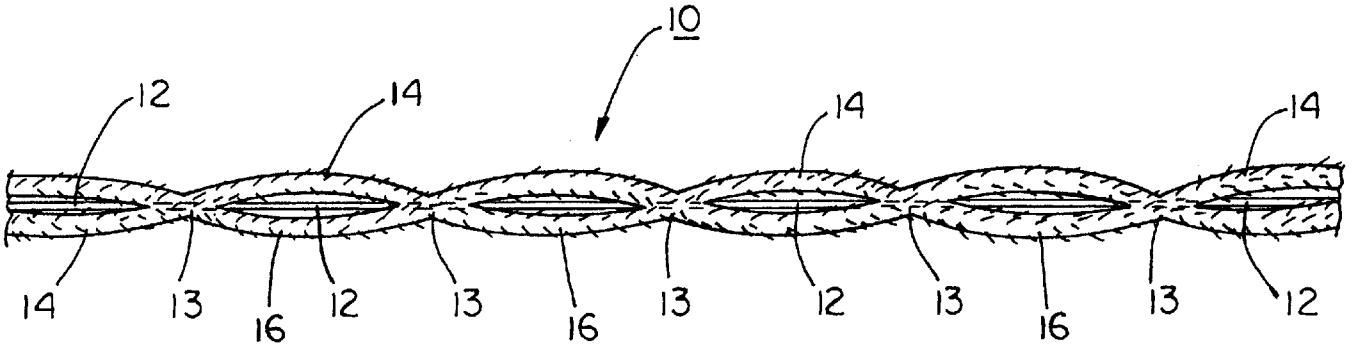
FIG. 1 is a schematic representation of the structure of the combined yarn of the present invention.
Figure 6:
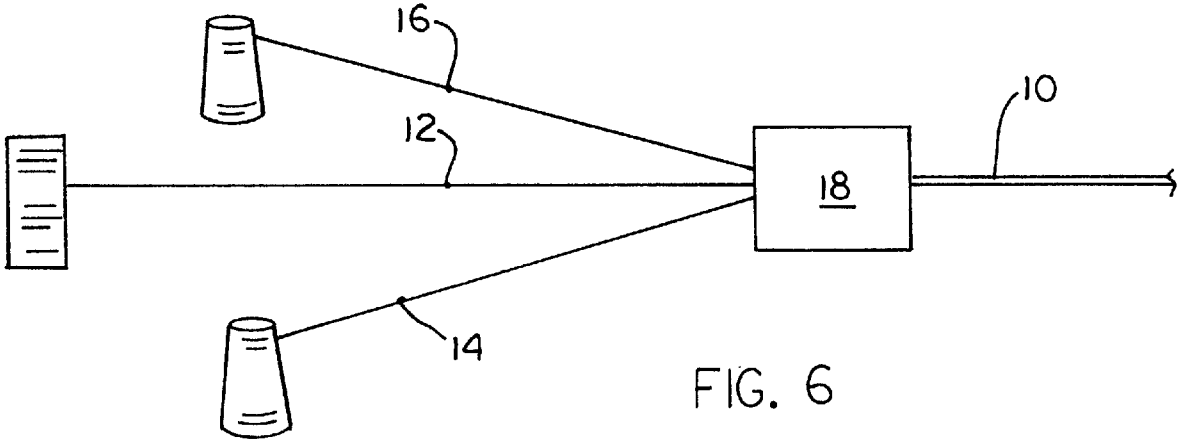
FIG. 6 is a schematic representation of the method of making the combined yarn of the present invention.

The term "fiber" as used herein, refers to a fundamental component used in the assembly of yarns and fabrics. Generally, a fiber is a component that has a length dimension that is much greater than its diameter or width This term includes ribbon, strip, staple, and other forms of chopped, cut or discontinuous fiber and the like having a regular or irregular ross section. "Fiber" also includes a plurality of any one of the above or a combination of he above.

As used herein, the term "high performance fiber" means that class of fibers having high values of tenacity such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yam can occur in a variety of forms to include a spun yarn consisting of staple fibers usually bound together by twist; a multifilament yarn consisting of many continuous filaments or strands; or a monofilament yarn that consists of a single strand.

The term "combined yarn" as used herein refers to a yarn that is comprised of a cut resistant strand combined with a non-cut resistant strand and/or a fiberglass strand at intermittent points by air entanglement of the strand components.

The term "composite yarn" as used herein refers to a yarn that is comprised of a core yarn wrapped with one or more cover yarns.

The term "air interlacing" as used herein refers to subjecting multiple strands of yarn to an air jet to combine the strands and thus form a single, intermittently commingled strand, i.e., a combined yarn. This treatment is sometimes referred to as "air tacking." In "air interlacing", as the term is used herein, adjacent strands of a cut resistant yarn and a non-cut resistant yarn and/or fiberglass, at least one strand being a multifilament strand, are passed with minimal, i.e., less than 10% overfeed, through an entanglement zone in which a jet of air is intermittently directed across the zone, generally perpendicular to the path of the strands. As the air impinges on the adjacent fiber strands, the strands are whipped about by the air jet and become intermingled or entangled at spaced zones or nodes. The resulting combined yarn is characterized by spaced, air entangled sections or nodes in which the fibers of the strands are entangled or "tacked" together, separated by segments of non-entangled adjacent fibers.

The term "encasing" or "encased", as used herein means that the interlaced non-metallic yarns capture and hold the will within and/or alongside the interlaced yarns as a unitary combined yarn.

A combined yarn 10 according to the present invention is illustrated schematically in FIG. 1. The combined yarn can be used in combination with other yarn strands to make a cut resistant composite yarn and includes at least one wire strand 12 and at least two strands 14, 16 comprised of an inherently cut resistant material, 14, and a non-cut resistant material or fiberglass 16. Strands 14 and 16 are interlaced with each other and around wire strand 12 to form attachment points 13 intermittently along the lengths of the single combined strand 10. Desirably, one or the other of the strands 14, 16 is a multi-filament strand. The strands 14, 16 are air interlaced around the wire using well-known devices devised for that purpose. A suitable device 18 includes the SlideJet -FT system with vortex chamber available from Heberlein Fiber Technology, Inc.

This device will accept multiple running multi-filament yarns and the wire strand. The yarns are exposed to a plurality of air streams such that the filaments of the yarns are uniformly intertwined with each other over the length of the yarn and around the wire. This treatment also causes intermittent interlacing of the yarn strands to form attachment points between the yarn strands along their lengths. These attachment points, depending on the texturizing equipment and yarn strand combination used, are normally separated by lengths of non-interlaced strands having a length of between about 0.125 and about one inch. The number of yarn strands per unit length of a combined interlaced strand will very depending on variables such as the number and composition of the yarn strands fed into the device. The practice of the present invention does not include the use of yarn overfeed into the air interlacing device. The air pressure fed into the air-interlacing device should not be so high as to destroy the structure of any spun yarn used in the practice of the present invention.

The combined yarn illustrated in FIG. 1 may be used alone or may be combined with other strands to create a variety of composite yarn structures. In the preferred embodiment depicted in FIG. 2, the composite yarn 20 includes combined yarn core strand 22 made according to the above described technique overwrapped with a first cover strand 24. The cover strand 24 is wrapped in a first direction about the core strand 22. A second cover strand 26 is overwrapped about the first core strand 24 in a direction opposite to that of the first core strand 24. Either of the first cover strand 24 or second cover strand 26 may be wrapped at a rate between about 3 to 16 turns per inch with a rate between about 8 and 14 turns per inch being preferred. The number of turns per inch selected for a particular composite yarn will depend on a variety of factors including, but not limited to, the composition and denier of the strands, the type of winding equipment that will be used to make the composite yarn, and the end use of the articles made from the composite yarn.

Turning to FIG. 3, an alternative composite yarn 30 includes a first combined yarn core strand 32 made in accordance to the above described technique laid parallel with a second core strand 34. This two-strand core structure is overwrapped with a first cover strand 36 in a first direction, which may be clock-wise our counter clock-wise. Alternatively, the composite yarn 30 may include a second cover strand 38 overwrapped about the first cover strand 36 in a direction opposite to that of the first cover strand 36. The selection of the turns per inch for each of the first and second cover strands 36, 38 may be selected using the same criteria described for the composite yarn illustrated in FIG. 2.

An alternative embodiment 40 is illustrated in FIG. 4. This embodiment includes a composite yarn core strand 42 made in accordance with the technique described above that has been wrapped with a single cover strand 44. This cover strand is wrapped about the core at a rate between about 8 and 16 turns per inch. The rate will vary depending on the denier of the core and cover strands and the material from which they are constructed. It will be readily apparent that a large number of core cover combinations may be made depending on the yarn available, the characteristics desired in the finished goods, and the processing equipment available. For example, more than two strands may be provided in the core construction and more than two cover strands can be provided.

Strand 12 is constructed of a flexible metallic, preferably annealed, very fine wire. The strand is desirably of stainless steel. However, other metals, such as malleable iron, copper or aluminum, will also find utility. The wire should have a total diameter of from about 0.0016 to about 0.004 inch, and preferably from about 0.002 to about 0.003 inch. The wire may be comprised of multiple wire filaments, with the total diameters of the filaments being within these ranges.

The inherently cut resistant strand 14 may be constructed from high performance fibers well known in the art. These fibers include, but are not limited to an extended-chain polyolefin, preferably an extended-chain polyethylene (sometimes referred to as "ultrahigh molecular weight polyethylene"), such as Spectra® fiber manufactured by Allied Signal; an aramid, such as Kevlar® fiber manufactured by DuPont De Nemours; and a liquid crystal polymer fiber such as Vectran® fiber manufactured by Hoescht Celanese. Another suitable inherently cut resistant fiber includes Certran® M available from Hoescht Celanese.

These and other cut resistant fibers may be supplied in either continuous multi-filament form or as a spun yarn. Generally, it is believed that these yarns may exhibit better cut resistance when used in continuous, multi-filament form. The denier of the inherently cut resistant strand may be any of the commercially available deniers within the range between about 70 and 1200, with a denier between about 200 and 700 being preferred.

In order to prevent stretching, kinking, and forming knots of the wire component during knitting of garments, and resultant kinking and knotting or the wire, the cut-resistant yarn should be "stronger" having a higher tenacity and a greater resistance to stretching.

The non-cut resistant strand 16 may be constructed from one of a variety of available natural and man made fibers. These include polyester, nylon, acetate, rayon, cotton, polyester-cotton blends. The manmade fibers in this group may be supplied in either continuous, multi-filament form or in spun form. The denier of these yarns may be any one of the commercially available sizes between about 70 and 1200 denier, with a denier between about 140 and 300 being preferred and a denier.

If the non-cut-resistant strand 16 is fiberglass, it may be either E-glass or S-glass of either continuous filament or spun construction. Preferably, the fiberglass strand has a denier of between about 200 and about 2,000. Fiberglass fibers of this type are manufactured both by Corning and by PPG and are characterized by various properties such as relatively high tenacity of about 12 to about 20 grams per denier, and by resistance to most acids and alkalies, by being unaffected by bleaches and solvents, and by resistance to environmental conditions such as mildew and sunlight and highly resistant to abrasion and aging. The practice of the present invention contemplates using several different sizes of commonly available fiberglass strands, as illustrated in Table 1 below:

TABLE 1

Standard Fiberglass Sizes

| Fiberglass Size | Approximate Denier |
|---|---|
| G-450 | 99.21 |
| D-225 | 198.0 |
| G-150 | 297.6 |
| G-75 | 595.27 |
| G-50 | 892.90 |
| G-37 | 1206.62 |

The size designations in the Table are well known in the art to specify fiberglass strands. These fiberglass strands may be used singly or in combination depending on the particular application for the finished article. By way of non-limiting example, if a total denier of about 200 is desired for the fiberglass component of the core, either a single D-225 or two G-450 strands may be used. Suitable fiberglass strands are available from Owens-Corning and from PPG Industries.

The cover strands in the embodiments depicted in FIGS. 2–4 may be comprised of either wire strands, inherently cut resistant materials, non-cut resistant materials, fiberglass, or combinations thereof, depending on the particular application. For example, in the embodiments having two cover strands, the first cover strand may be comprised of an inherently cut resistant material and the second cover strand may be comprised of a non-cut resitant material such as nylon or polyester. This arrangement permits the yarn to be dyed or to make a yarn that will create particular hand characteristics in a finished article.

Table 2 below illustrates exemplary four component combinations of wire strands, cut resistant strands, non-cut resistant strands, and fiberglass strands joined by an air intermingling process. Each of the examples in Table 2 is prepared using the Heberlein SlideJet-FT 15using a P312 head. The SlideJet unit is supplied air at a pressure between about 30 and 80 psi, with an air pressure between about 40 and 50 psi being preferred. Preferably, the air supply has an oil content less than 2 ppm, and desirably, is oil-free.

TABLE 2

Interlaced Yarn Embodiments

| Exp | No. Strands | Yarn Components |
|---|---|---|
| 1 | 4 | 650 Spectra Fiber<br>600 Fiberglass<br>_X 500 Textured Polyester<br>0.002 Stainless Steel Wire |
| 2 | 4 | 650 Spectra Fiber<br>1200 Fiberglass<br>_X 840 Nylon<br>0.002 Stainless Steel Wire |
| 3 | 4 | 375 Spectra Fiber<br>300 Fiberglass<br>_X 1000 Polyester<br>0.003 Stainless Steel Wire |
| 4 | 4 | _Kevlar Fiber<br>1200 Fiberglass<br>_X 840 Nylon<br>0.002 Stainless Steel Wire |
| 5 | 4 | _Kevlar Fiber<br>300 Fiberglass<br>_X 1000 Polyester<br>0.003 Stainless Steel Wire |

Table 3 illustrates the manufacture of three component combined yarns:

TABLE 3

Interlaced Yarn Embodiments

| Exp | No. Strands | Yarn Components |
|---|---|---|
| 6 | 3 | 650 Spectra Fiber<br>_X 500 Textured Polyester<br>0.002 Stainless Steel Wire |
| 7 | 3 | 375 Spectra Fiber<br>_X 500 Nylon<br>0.002 Stainless Steel Wire |
| 8 | 3 | 1200 Spectra Fiber<br>_X 1000 Polyester<br>0.003 Stainless Steel Wire |
| 9 | 3 | _Kevlar Fiber<br>_X___Nylon<br>0.002 Stainless Steel Wire |
| 10 | 3 | _Kevlar Fiber<br>_X___Polyester<br>0.003 Stainless Steel Wire |
| 11 | 3 | 300 Fiberglass<br>_X 500 Textured Polyester<br>0.002 Stainless Steel Wire |
| 12 | 3 | 890 Fiberglass<br>_X 1000 Polyester<br>0.002 Stainless Steel Wire |
| 13 | 3 | 600 Fiberglass<br>_X 840 Nylon<br>0.003 Stainless Steel Wire |
| 14 | 3 | 650 Spectra Fiber<br>600 Fiberglass<br>0.002 Stainless Steel Wire |
| 15 | 3 | 1200 Spectra Fiber<br>1200 Fiberglass<br>0.003 Stainless Steel Wire |
| 16 | 3 | 375 Spectra Fiber<br>300 Fiberglass<br>0.003 Stainless Steel Wire |

TABLE 3-continued

| Interlaced Yarn Embodiments | | |
|---|---|---|
| Exp | No. Strands | Yarn Components |
| 17 | 3 | __Kevlar Fiber<br>__Fiberglass<br>0.002 Stainless Steel Wire |
| 18 | 3 | __Kevlar Fiber<br>__Fiberglass<br>0.003 Stainless Steel Wire |

In the illustrated embodiments, the fiberglass strand provides a cushioning effect that enhances the cut resistance of the high performance fiber. The wire stand also enhances cut resistance of the yarn. Advantageously, these affects are achieved without the time and expense of wrapping the high performance fiber around the fiberglass strands.

The following examples demonstrate the variety of the composite yarns that may be constructed using the combined yarn components of the preceding tables. The combined yarn is used as a core strand in each example. The specific composite yarn components illustrate the invention in an exemplary fashion and should not be construed as limiting the scope of the invention.

TABLE 4

| Composite Yarn Examples | | | |
|---|---|---|---|
| Exp | Interlaced Strand Core | First Cover | Second Cover |
| 19 | Exp 1 | 150 Polyester | 150 Polyester |
| 20 | Exp 3 | 70 Polyester | 150 Polyester |
| 21 | Exp 4 | 70 Polyester | 70 Polyester |
| 22 | Exp 5 | 200 Spectra | 840 Nylon |
| 23 | Exp 6 | 200 Spectra | 200 Spectra |
| 24 | Exp 7 | 375 Spectra | 500 Nylon |
| 25 | Exp 8 | 650 Spectra | 650 Spectra |
| 26 | Exp 9 | 375 Spectra | 1000 Spectra |
| 27 | Exp 10 | 375 Spectra | 5/1 Cotton |
| 28 | Exp 11 | 200 Spectra | 200 Spectra |
| 29 | Exp 12 | 36/1 Spun Polyester | 36/1 Spun Polyester |
| 30 | Exp 13 | 150 Polyester | 150 Polyester |
| 31 | Exp 14 | 70 Nylon | 70 Nylon |
| 32 | Exp 15 | 840 Nylon | 840 Nylon |

Knit gloves, as illustrated in FIG. 5, made with the present interlaced yarns are more flexible and provide better tactile response than similarly constructed gloves of conventional composite yarns in which a steel wire forms a component of the composite yarn core, and have similar levels of cut resistance. Kinking and knotting of the steel component is prevented during knitting by the greater stretch resistance of the intermittently entangled cut-resistant yarn component. Also, the steel is better protected from breakage, and the ends of the wires, if breakage should occur, are less likely to protrude from the fabric surface.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What is claimed is:

1. A cut resistant composite yarn comprised of:

a) a core yarn including i) a first metallic strand;

ii) a first non-metallic strand of a cut resistant material; and iii) a second non-metallic strand of a cut resistant material, a non-cut resistant material, or fiberglass;

said first and second non-metallic strands being air interlaced with each other at intermittent areas along the lengths of said strands, at least one of said non-metallic strands being a multifilament strand, said metallic strand being encased within said non-metallic strands along at least a part of the length of said metallic strand; and b) at least one cover yarn wrapped around said core yarn in a given direction.

2. The yarn of claim 1, further including a third non-metallic strand of a cut resistant material, a non-cut resistant material or fiberglass, said third strand being of a different material than said second strand, said third strand being air interlaced with said first and second strands.

3. The yarn of claim 1, wherein said metallic strand is of stainless steel.

4. The yarn of claim 1, wherein said metallic strand has a diameter of from about 0.0016 to about 0.004 inch.

5. The yarn of claim 1, wherein said first non-metallic strand is of a cut resistant material selected from the group consisting of ultrahigh molecular weight polyethylene, aramids, and high strength liquid crystal polymers.

6. The yarn of claim 1, wherein said second non-metallic strand is of a non-cut resistant material selected from the group consisting of polyester, nylon, acetate, rayon, and cotton.

7. The yarn of claim 1, wherein said intermittent points are spaced from between about 0.125 to about one inch apart.

8. The yarn of claim 1, wherein said second non-metallic strand is of a cut resistant or non-cut resistant material, and has a denier of from about 70 to about 1200.

9. The yarn of claim 1, wherein said second strand is of fiberglass, and has a denier of from about 200 to about 2,000.

10. The yarn of claim 1, wherein said cover yarn is of a material selected from the group consisting of ultrahigh molecular weight polyethylene, aramids, high strength liquid crystal polymers, polyesters, nylon, acetate, rayon, cotton, polyolefins, and fiberglass.

11. The yarn of claim 1, further including a second cover yarn wrapped around said core yarn in the opposite direction from said first cover yarn.

12. The yarn of claim 11, wherein said second cover yarn is of a material selected from the group consisting of ultrahigh molecular weight polyethylene, aramids, high strength liquid crystal polymers, polyesters, nylon, acetate, rayon, cotton, polyolefins, and fiberglass.

13. A method of manufacturing a cut resistant yarn comprising:

a) positioning a first strand of a metal adjacent a first non-metallic strand of a cut resistant material and a second non-metallic strand of a cut resistant material, a non-cut resistant material, or fiberglass, at least one of said strands being of a multi-filament material; and b) passing said metal strand and said non-metallic strands through an air jet texturizing device where an air jet impinges against said strands at intermittent points to entangle said non-metallic strands, said non-metallic strands encasing said metallic strand at least at some of said intermittent points.

14. The yarn of claim 13, wherein said first strand is of stainless steel and has a diameter of from about 0.0016 to about 0.004 inch.

15. The method of claim 13, wherein said second strand is of a material selected from the group consisting of ultrahigh molecular weight polyethylene, aramids, high strength liquid crystal polymers, polyester, nylon, acetate, rayon, cotton, and polyolefins.

16. The method of claim 13, wherein said intermittent points are spaced from between about 0.125 to about one inch apart.

17. The method of claim 13, further including the step of wrapping a first cover yarn in a first direction around said combined yarn.

18. The method of claim 17, wherein said first cover yarn is of a material selected from the group consisting of ultrahigh molecular weight polyethylene, aramids, high strength liquid crystal polymers, polyester, nylon, acetate, rayon, cotton, polyolefins, and fiberglass.

19. The method of claim 17, further including the step of wrapping a second cover yarn around said combined yarn in a direction opposite from said first cover yarn.

20. The method of claim 19, wherein said second cover yarn is of a material selected from the group consisting of ultrahigh molecular weight polyethylene, aramids, high strength liquid crystal polymers, polyester, nylon, acetate, rayon, cotton, polyolefins, and fiberglass.

* * * * *